United States Patent [19]

Marchetti

[11] 4,043,186

[45] Aug. 23, 1977

[54] FLAT EXPANSIBLE MEMBRANES ARRANGEMENT TO MEASURE ON LOCATION THE MODULE OF DEFORMABILITY OF TERRAINS NOT REQUIRING THE EXECUTION OF SOUNDING PERFORATIONS

[76] Inventor: Silvano Marchetti, Via Bracciano, 38-00159, Roma, Italy

[21] Appl. No.: 626,625

[22] Filed: Oct. 29, 1975

[30] Foreign Application Priority Data

Oct. 31, 1974 Italy ..... 53837/74

[51] Int. Cl.[2] ..... G01N 3/00

[52] U.S. Cl. ..... 73/84

[58] Field of Search ..... 73/84, 88 E, 151

[56] References Cited

U.S. PATENT DOCUMENTS 3,446,062 5/1969 Goodman et al. ..... 73/84

FOREIGN PATENT DOCUMENTS 272,146 10/1970 U.S.S.R. ..... 73/84

*Primary Examiner*—James J. Gill
*Assistant Examiner*—Anthony V. Ciarlante

[57] ABSTRACT

A probe to measure the modulus of terrain deformability comprising a means for the induction of pressure into a hollow chamber which is to be buried below ground level, said hollow chamber having flexible metal membranes in portions of its wall. The pressure equalization being measured by movement of the metal membranes which generate a change in electrical impetus between membranes and electrical connectors therewith.

8 Claims, 4 Drawing Figures

FLAT EXPANSIBLE MEMBRANES ARRANGEMENT TO MEASURE ON LOCATION THE MODULE OF DEFORMABILITY OF TERRAINS NOT REQUIRING THE EXECUTION OF SOUNDING PERFORATIONS

This invention refers to apparatus having flat expansible membranes for measuring on location the deformability modules of soil layers.

The importance of being able to measure as accurately and correctly as possible the modules of land deformability is well known.

In particular, the reproducibility of these measurements is of special importance. The measurements must, therefore, be affected as little as possible by the means with which they are carried out.

Such measurements are today generally conducted by means of apparatus called presso-meters, which are characterized as having elastic expansible structures with pressure exerted in all directions on the cavity inside of which they operate.

These prior art devices rely upon the utilization of sound waves once the device is in the ground and accurate measurement requires great care and is time consuming. Also, when these devices are used, reproducible measurement is extremely difficult.

There are penetrometers available which do not rely on sound waves, but they are designed to break up the soil rather than measure the modules of deformability.

The overcoming of these difficulties has been solved by means of the arrangements of this invention which has as its primary purpose, the bringing of an accurate reliable and repetitive measurement of the deformability modules of soil strata without necessarily requiring the relative measurement of sound wave penetration.

This invention relates to a probe to measure on location the deformability modules of the soil characterized by the body being of parallelepiped shape, and equipped with a point in order to facilitate the penetration into the soil. The probe also includes a pressure chamber communicating with the outside through two circular openings placed on the two opposite faces of said probe body; two metallic expansible membranes, closing tight said circular openings of the pressure chamber; means for the introduction of compressed air in said chamber; a discharging valve for the compressed air and electric contacts acting in response to the movement of said metallic membranes.

Measurement means will be later equipped with elements for fastening them to conventional advancement rods that may have transversal sections similar to the point or of different shape, e.g., circular.

Therefore, an important advantage offered by this invention is that thrust arrangements can be used for the introduction into the soil which are in current use for the static penetrometers with resulting overall reduction in cost.

Another advantage is represented by the fact that the horizontal translation of the pressurized membranes presses the terrain according to a direction that simulates perfectly the horizontal component of the displacement of a pole in the ground, yielding valuable information concerning the land resistance in comparison to such component.

This invention will be described now in exemplified manner, but not limited to its particular embodiment by the enclosed drawings in which FIG. 1 shows a side view of this invention arrangement and FIG. 2 shows a section taken according to line 2—2 of FIG. 1.

FIG. 3 is on an exaggerated scale for illustrative purposes only, and in reality, the movement of the membrane is approximately lmm., and normal dimensioning would not reveal the point to be illustrated.

Figure 1:
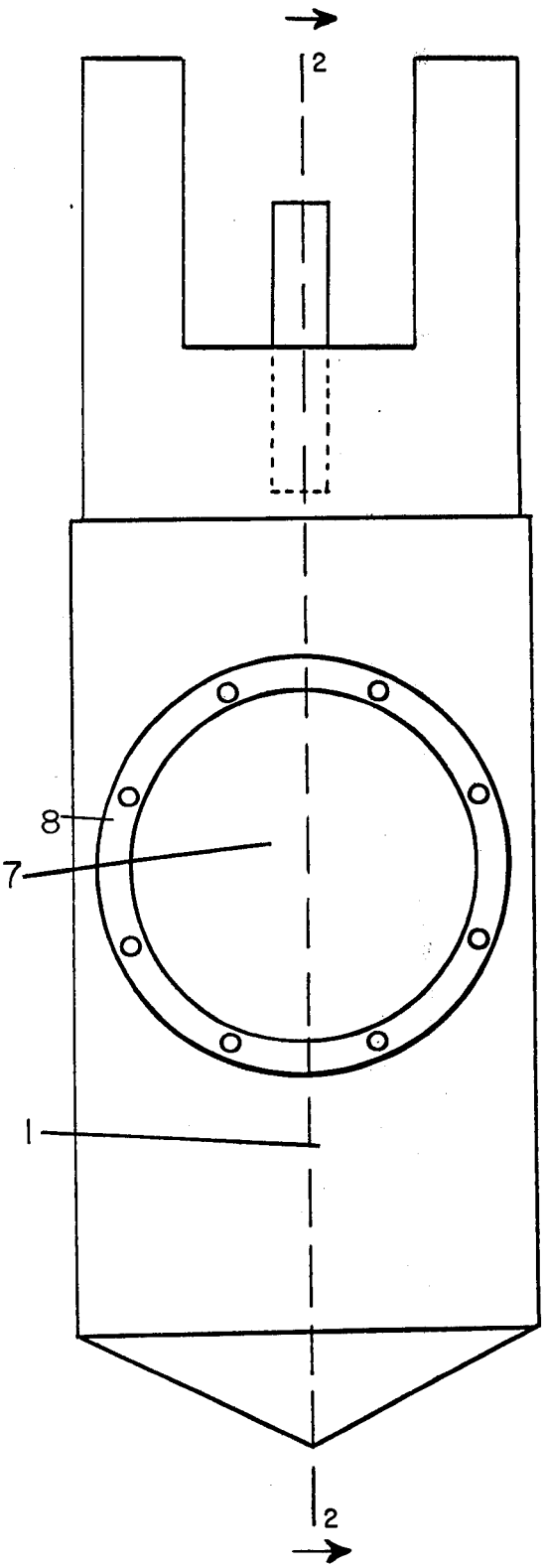
Figure 4:
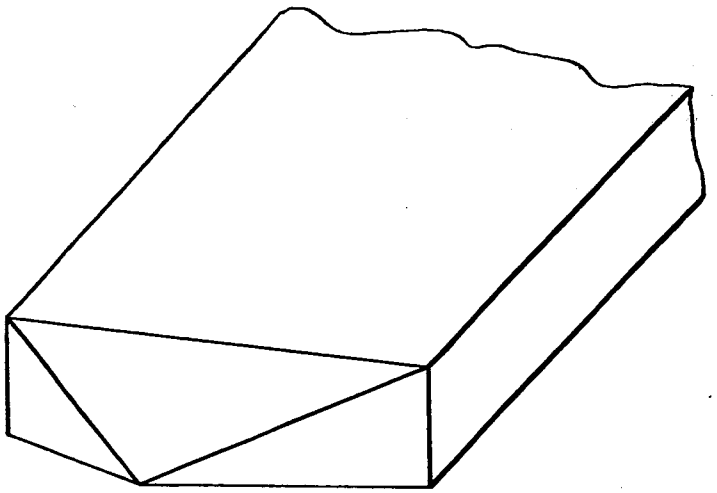
FIG. 4 shows an isometric view of the final section of the probe illustrating its parallelepiped shape, which is tapered to a point.
Figure 3:
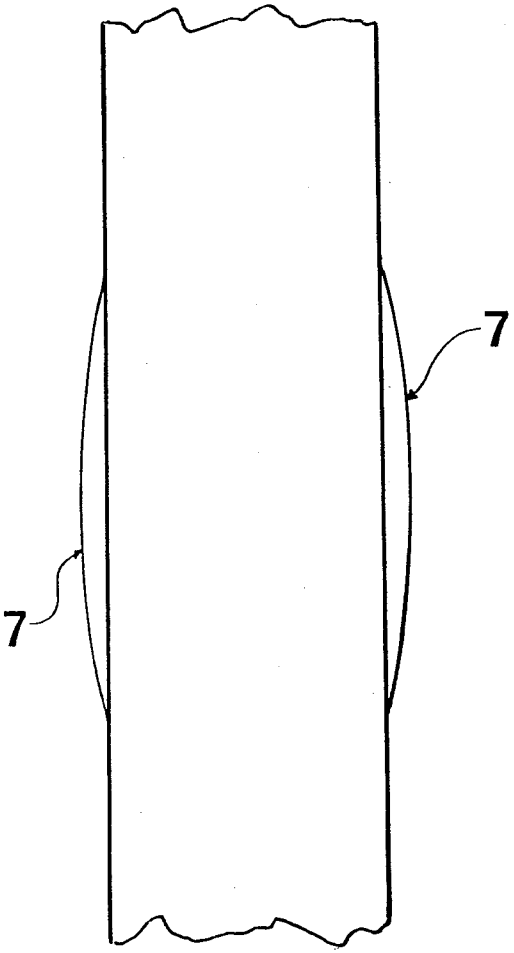
FIG. 3 shows a side view of that part of the device of the invention which falls between Lines A–A' in FIG. 2, illustrating the membranes in their expanded position.

With particular reference to FIG. 1, we see the body of the probe equipped with a point adapted to permit the introduction and the advancement of the probe into the terrain.

Inside of said probe there is the cylindrical pressure chamber 2, with horizontal axis that communicates with the outside by means of two circular openings 3 facing on two opposite faces of the probe body.

In external concentric position respect to each of the mentioned openings there is a circular slot 5 in which will be housed fastening flanges as described below.

The superficial plane 5 of the probe body included between the circular opening 3 and slots 4 is slightly indented with respect to the external plane 6 of the probe surface by an amount equal to the thickness of membrane 7.

These cup-shaped metal membranes press down upon gaskets 9 located at the bottom of circular recesses 4 and are mounted by means of screws to metal flanges 8 located above the recesses. This arrangement does not allow the membranes to present a barrier to insertion of the probe in the soil.

Inside the external openings 3 in the housing specially made for such purpose, there are two washers of insulating material 10 which besides making an internal surface of support and protection for the membranes, also hold and position the discharge valve.

The openings 3 are essentially equipped with a small cylinder 11 closed at one end, provided with an access hole for air 12 and with a discharge nozzle 13.

Inside of the small cylinder there is a small piston 15 that is free to slide tightly, and which compresses a helicoidal spring 16 that acts between the internal end of the small piston and the closing of the small cylinder. The other end of the small piston 15 and the external surface of the closed part of the small cylinder 11, rest on the internal surfaces of the membranes 7 through the central holes of the washers 10.

The isolating washers 10 are crossed by two pin electric contacts $x$ and $y$ that establish electrical contact with membranes 7.

The two contacts are connected by a small cable to the central switchboard placed outside. The discharge nozzle 13 is connected by means of a small tube of metal or plastic 17 with the outside, while it is possible to inject compressed air in the pressure chamber across conduit 18.

Advancement rods which are commonly used for other types of probes are added to the upper part of this probe while it penetrates the surface of the terrain.

Such rods will have to provide in their inside for the passage of the conduits for the air intake and discharge and for the small cables for electric contact that will be connected by traditional means to conduit 18, small tube 17 and to contacts $x$ and $y$, respectively.

The control panel naturally placed on the surface, has a source of pressure that, through the interposition of a pin valve permits the introduction of gas, the pressure of which is controlled by means of a manometer. This, too, is placed in the control panel and connected by a pneumatic conductor to the control cable. The panel also includes a battery that actuates two luminous warnings when the two electric conductors of the control cable develop a short circuit with the block in proximity of the point.

The apparatus will now be described in relationship to its use.

As the point is thrust into the ground at the desired depth compressed air is gradually introduced through the conduit 18, into the pressure chamber. This air acts on the membranes and in a short time it will simply counteract the pressure of the terrain acting in contrary direction on the membranes. As soon as the thrust into the terrain has been equalized a further small increase of the inside pressure will initiate the movement of the membranes toward the outside. As soon as this is accomplished the membranes will detach themselves from the pin contacts $x$ and $y$ interrupting the circuit and, therefore, signaling in the switchboard the initial happening of the membranes movement.

By reading the pressure valve $p_1$ on the manometer in that instant we will know the pressure developed in the terrain before the movement of the membranes.

Figure 2:
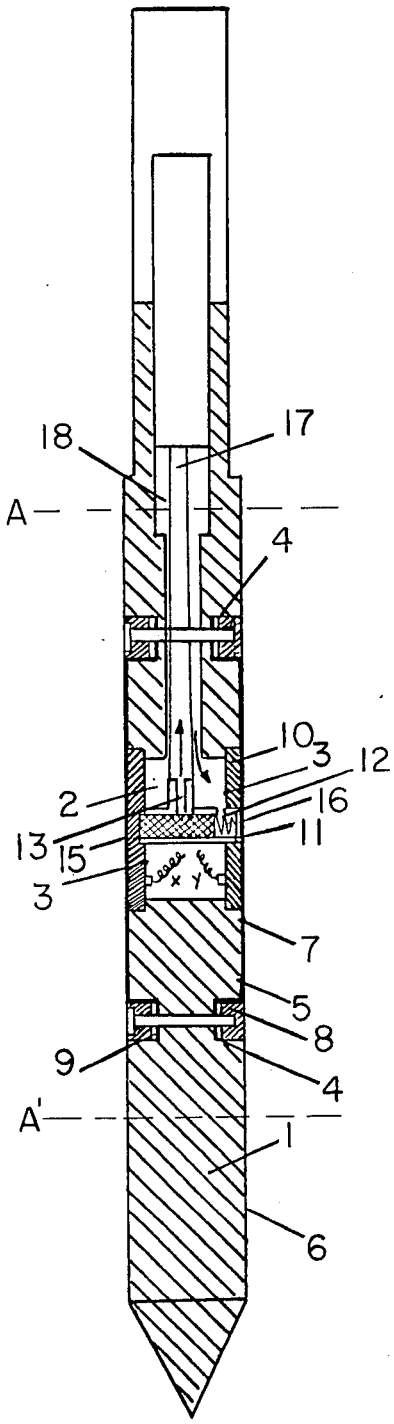

Continuing to send gas, the membranes expand themselves and spring 16 contained in cylinder 11 dislodges the small piston 15 which follows the movement of the membranes on the left as seen at FIG. 2, while the small cylinder 11, follows the right-hand membrane. As the introduction of air is continued, the two membranes move away from each other so that the inside end of the small piston 15 uncovers the discharge orifice, i.e., nozzle 13. At this point an equilibrium situation is created between the internal and the external pressure due to the restraining forces of the terrain as the air admitted in excess is discharged through nozzle 13. This is signaled by the switchboard manometer with the addition of a constant value $p_2$ of the pressure inside the chamber.

By the difference $P_1$ and $P_2$ and from the value of the distance covered by the membranes it is possible to calculate the value of the deformability modules of the terrain through the theory of the slabs propped on the elastic ground.

Obviously the system of relieving the pressures and of displacing can be made in many other ways; or may also be relieved in continuous manner the pressure-displacement curves substituting a transductor of displacement for the pneumatic system and the electric contacts.

The invention has been described in relation in its one particular embodiment, but various modifications of construction may be made without departing from the spirit of protection of this invention.

I claim:

1. Probe to measure the modulous of terrain deformability in situ, comprising parallelipiped shaped probe rods tapering to a point for penetration into the terrain, a pressure chamber communicating with the outside through two circular openings situated on opposite faces of said probe body, two expansible metal membranes sealingly covering said circular openings said metal membranes becoming hemispheroidally shaped upon the introduction of compressed air to said chamber; means for introduction and removal of said air from said chamber and electrical contact means acting in response to the movement of said metal membrane.

2. Probe of claim 1, comprising a discharge valve located inside said pressure chamber, said discharge valve has a small cylinder closed at one end and equipped with an access vent for air and a discharge nozzle 13, a small piston free to tightly slide inside of small cylinder and urging means acting between the internal end of said small piston and the closed end of said small cylinder to control said valve.

3. Probe of claim 1, in which electric contact means consist of a plurality of pin elements and insulating washers with said pins secured on the internal surface of said washers, passing through them and resting on the metallic membranes so as to be electrically responsive to their displacement due to the interruption provoked by such displacement.

4. Probe of claim 3, in which the displacement of the membranes of a predetermined amount activates electric signal registration by the equilibrium of pressure to the inside of the pressure chamber.

5. Probe of claim 1 in which said membranes are secured at one end by a system of compressing metallic flanges.

6. Probe of claim 1, characterized by the pressure chamber having circuit opening equipped with insulating washers to support internal surface of said membranes.

7. Method for the measure, on location, of the modules of elasticity of the terrain by the apparatus of claim 1, in which first compressed air in injected into said pressure chamber to equalize first the pressure developed by the terrain on the membranes, and afterward continuing to inject air until it is greater than said terrain pressure, thus provoking a deformation of said membranes toward the outside of the probe, said deformation provoking the reciprocal movement of separation of said piston and said small cylinder under the action of said thrust-spring until is uncovered said discharge opening of the small cylinder that permits the emission of the excess air toward the outside.

8. Method as per claim 7, characterized by the fact that the beginning of said deformation of the membranes toward the outside determines the detachment of said membranes from said elements of electric contacts thus provoking the interruption of the electric circuit that closes through the body of the probe with consequent electrical indication.

* * * * *